United States Patent [19]

Joseph

[11] 4,306,317

[45] Dec. 22, 1981

[54] COMPETITION SWIMSUIT FOR WOMEN

[75] Inventor: Michel Joseph, Saverne, France

[73] Assignee: Adidas Fabrique de Chaussures de Sport, Landersheim, France

[21] Appl. No.: 113,100

[22] Filed: Jan. 17, 1980

[30] Foreign Application Priority Data

Jan. 22, 1979 [FR] France ..... 79 01493

[51] Int. Cl.[3] ..... A41D 5/00

[52] U.S. Cl. ..... 2/67

[58] Field of Search ..... 2/67

[56] References Cited

U.S. PATENT DOCUMENTS

| | | | |
|---|---|---|---|
| D. 87,375 | 7/1932 | Whiting | D2/40 |
| D. 249,096 | 8/1978 | Fowler | D2/40 |
| 1,867,445 | 7/1932 | Dills | 2/67 |
| 1,908,591 | 5/1933 | Entraygues | 2/67 |

FOREIGN PATENT DOCUMENTS

| | | | |
|---|---|---|---|
| 734168 | 7/1932 | France | 2/67 |
| 943256 | 10/1948 | France | 2/67 |

*Primary Examiner*—Doris L. Troutman

*Attorney, Agent, or Firm*—Cushman, Darby & Cushman

[57] ABSTRACT

A one-piece woman's competition swimming suit has a continuous elastic edging, made in a single piece, forming a closed loop around the openings for the passage of the legs in the lower portion of the suit, rising at a slant along the lateral sides of the suit, then forming the lower peripheral edging of the upper portion of the suit, and joined to a transverse edging of the upper portion of the back of the suit essentially in a central region thereof in which two back straps converge, and are also connected to the transverse edging. The transverse edging can form a continuation of the armpit edging of a breast panel of the suit.

2 Claims, 5 Drawing Figures

COMPETITION SWIMSUIT FOR WOMEN

The object of the present invention is a novel swimming suit for women particularly for use in competition.

For a long time attempts have been made to improve the performances of competitive swimmers by improving the swimming suits that they wear.

Thus, the use of particular fabrics and very form-fitting bathing suits have been conceived to obtain better hydrodynamic characteristics.

Swimming suits have also been made in a single piece comprising a breast panel forming the front portion of the suit and a notched back connected to the breast panel by back straps fitting over the shoulders.

Swimming suits are also known of the type in which the back of the suit is bordered at its upper portion by a transverse edging, meeting essentially at the level of the armpits with the lateral edgings of the breast panel of the suit, and basically at the center of which the back straps connecting the back of the suit to the breast panel converge without crossing. Such suits have the advantage with respect to those previously known of exerting a less significant pressure on the shoulders of the swimmer thus eliminating a constraint in competition without interfering with performance. These known suits do, however, have the disadvantage that the back comprises an upper portion and a lower portion separated by a large cut-out section between them, and thus the lower portion of the suit has a tendency, in use, to separate slightly from the body of the swimmer which can decrease her performance.

The present invention relates to a swimming suit for women made in one piece, especially for use in competitive swimming, which is easy to make and which avoids the above disadvantage.

The swimming suit according to the invention is of the type described above in which the back of the suit is bordered at its upper portion by a transverse edging, connecting essentially at the level of the armpits with the lateral edgings of the breast panel of the suit, and essentially at the center of which the two back straps connecting the back of the suit to the breast panel converge without crossing, the suit being essentially characterized by the fact that it includes a continuous elastic edging made in a single piece forming a closed loop around the openings for passage of the legs in the lower portion of the suit, slanting upwardly along the lateral sides of the suit, and then forming the peripheral edging of the upper portion of the suit and joined to the transverse edging of the upper portion of the back essentially in the region where the two back straps converge.

Thus, it is understood that this elastic edging insures, due to the tension exerted on it by the back straps, a pull towards the top, on the lower portion and the lateral sides of the suit causing it to cling to the body of the swimmer. The embodiment according to the invention also avoids the presence of the usual vertical assembly seam in the lower portion of the suit.

Advantageously, the lower portion forming the panty of the suit according to the invention has an elastic upper transverse edging connecting to the elastic edging described above, essentially at the level of the waist of the swimmer, which causes the suit to cling still more to the body.

In order to make the invention better understood, two particular embodiments will now be described by way of non-limiting examples, referring to the attached drawings in which.

Figure 2:
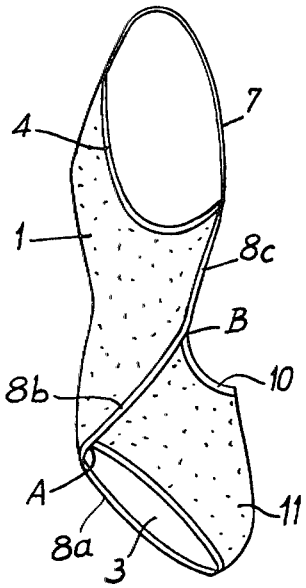
FIG. 2 shows a side view in elevation of a suit according to a first embodiment.
Figure 1:
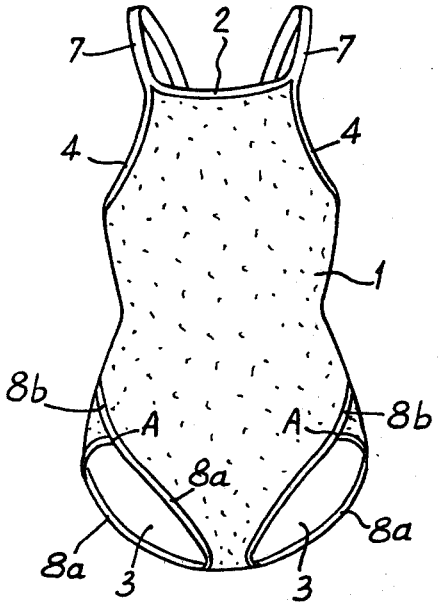
FIG. 1 shows a front view, of a swimming suit according to the invention, which is the same for both embodiments.
Figure 3:
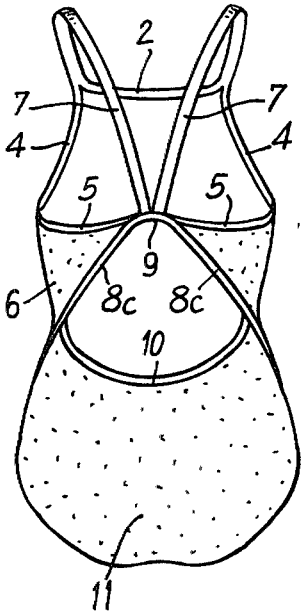
FIG. 3 shows a rear view of the suit of FIG. 2.
Figure 4:
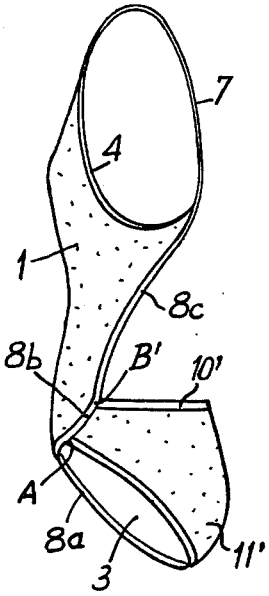
FIG. 4 is a view corresponding to FIG. 2 of a suit according to a second embodiment; and, FIG. 5 shows a rear view of the suit according to FIG. 4.
Figure 5:
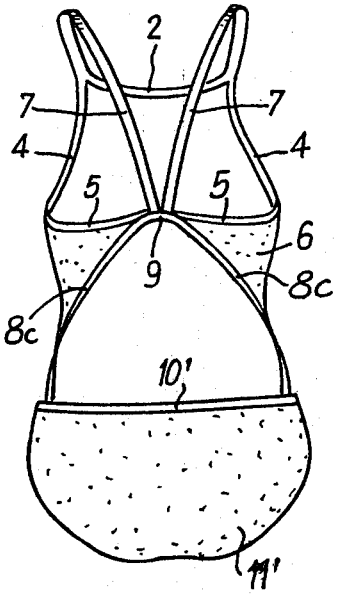

Referring to the drawings, it will be seen that the female swimming suit for competition according to the invention comprises a breast panel 1 forming the entire front portion of the suit and extending essentially from the base of the neck where it has an edging 2, to the pelvis where two openings 3 are provided for the passage of the legs.

The breast panel has at its upper portion two lateral edgings 4 which join at the level of the armpits to a transverse edging 5 defining the upper portion of the back 6 of the bathing suit.

The breast panel 1 and the back 6 of the suit are connected by two back straps 7, each extensions of the neck edging 2 and the lateral edgings 4 of the breast panel, beyond their point of convergence, the two straps 7 converging in the back so as to join without crossing to the transverse edging 5, basically at its center.

According to the present invention, in the two embodiments of the swimming suit shown in the drawings, there is provided a continuous elastic edging made in one piece forming a closed loop starting from the zones designated by A on the drawings around each of the openings 3 for the passage of the legs 1 as shown at **8*a*, this elastic edging being extended beyond each of the zones A by a section 8*b* rising at a slant along the lateral sides of the suit then forming the peripheral edging 8*c* of the upper portion 6 of the suit and joined to the transverse edging 5 of the upper portion of the back basically in central zone 9, in which the two back straps 7 converge. The elastic edging consisting of sections 8*a* and 8*b* and 8*c*** is advantageously made in a single piece or is composed of several band elements connected together, particularly sewn together.

To this elastic edging is joined at B and B′, respectively, the elastic upper transverse edging 10 and 10′, respectively, of the lower portion of the suit 11 and 11′, respectively. The zones of meeting B and B′ where the edgings are interconnected, particularly by seams, are located essentially at the waist of the swimmer. As can be seen by an examination of the drawings, the two embodiments shown differ one from the other in the particular shape of the lower portion of the suit 11 and 11′, respectively, the principle forming a continuous elastic edging **8*a*, 8*b*, 8*c*** being common to both embodiments.

Although the invention has been described in connection with particular embodiments, it is of course evident that it is not so limited, and may undergo various modifications without exceeding either its scope or its spirit.

I claim:

1. In a woman's one-piece bathing suit, particularly for use in competitive swimming, which bathing suit includes:

a breast panel forming a front portion for the bathing suit, said breast panel having opposite lateral edgings;

a back having an upper portion and a lower portion, said upper portion having an upper edging which joins with said opposite lateral edgings of said breast panel at the level of the armpits of the wearer and said lower portion having a pair of openings for the passage of the legs of the wearer;

two over-the-shoulder back straps connecting the breast panel with said upper portion of said back, said straps converging toward one another from said front panel toward said back, but without crossing one another, so as to connect with said upper portion of said back medially of said upper portion of said back;

the improvement wherein:

said bathing suit further comprises a unitary, continuous edging of elastic material forming closed loops perimetrically of the respective leg openings, rising laterally from respective frontal-upper sites on the respective closed loops and perimetrically bordering said upper portion of said back from below;

said unitary, continuous edging of elastic material joining said upper edging of said upper portion of said back, essentially where said back straps connect with said upper portion of said back.

2. The woman's one-piece bathing suit improvement of claim 3, wherein:

said lower portion, at least partly forming a panty of said bathing suit, has means defining an upper margin;

an edging of elastic material provided on said margin so as to extend transversely, this edging having opposite ends thereof joined to said unitary edging at the level of the waist of the wearer.

* * * * *

UNITED STATES PATENT AND TRADEMARK OFFICE

CERTIFICATE OF CORRECTION

PATENT NO. : 4,306,317

DATED December 22, 1981

INVENTOR(S) : Michel Joseph

It is certified that error appears in the above—identified patent and that said Letters Patent is hereby corrected as shown below:

In the Claims

Claim 2, line 2, in place of "3" insert --1--.

Signed and Sealed this

*Sixteenth* Day of *March 1982*

[SEAL]

*Attest:*

GERALD J. MOSSINGHOFF

*Attesting Officer* *Commissioner of Patents and Trademarks*

Disclaimer 4,306,317.—*Michel Joseph,* Saverne, France. COMPETITION SWIMSUIT FOR WOMEN. Patent dated Dec. 22, 1981. Disclaimer filed May 19, 1983, by the assignee, *Adidas Fabrique de Chaussures de Sport.*

The term of this patent subsequent to June 30, 1995, has been disclaimed.
(Official Gazette January 1, 1985)